United States Patent [19]

Selvin

[11] Patent Number: 4,531,790

[45] Date of Patent: Jul. 30, 1985

[54] ELECTRICAL CONNECTOR GROUNDING RING

[75] Inventor: Gerald J. Selvin, Huntington Beach, Calif.

[73] Assignee: International Telephone & Telegraph Corporation, New York, N.Y.

[21] Appl. No.: 548,757

[22] Filed: Nov. 4, 1983

[51] Int. Cl.[3] ..... H01R 4/66

[52] U.S. Cl. ..... 339/14 R; 339/143 R

[58] Field of Search ..... 339/143 R, 14 R, 89 R, 339/89 C, 89 M, 90 R, 90 C, 113 R

[56] References Cited

U.S. PATENT DOCUMENTS

| | | | |
|---|---|---|---|
| 3,448,430 | 6/1969 | Kelly | 339/143 |
| 3,621,448 | 11/1971 | Arnold | 339/94 |
| 3,949,343 | 4/1976 | Yonkers | 337/192 |
| 4,033,654 | 7/1976 | Ross | 339/143 R |
| 4,106,839 | 8/1978 | Cooper | 339/143 R |
| 4,126,372 | 11/1978 | Hashimoto et al. | 339/177 |
| 4,276,523 | 6/1981 | Boutros et al. | 339/143 R X |

*Primary Examiner*—Eugene F. Desmond

*Attorney, Agent, or Firm*—T. L. Peterson; R. C. Turner

[57] ABSTRACT

An electrical connector in which one connector member contains a grounding ring having a wall of "C"-shaped configuration in longitudinal section. When the mating halves of the connector are interengaged, the shell of the other connector member slides into the grounding ring deflecting the inner peripheral wall thereof outwardly. The ring provides a windowless EMI/RFI grounding shield for the connector.

4 Claims, 5 Drawing Figures

ELECTRICAL CONNECTOR GROUNDING RING

BACKGROUND OF THE INVENTION

The present invention relates generally to an electrical connector and, more particularly, to a grounding ring for an electrical connector which provides protection against RFI/EMI signals.

The use of shielding in electrical connectors to prevent unwanted radio frequency and electro-magnetic signals (RFI/EMI) from interfering with signals being carried by the contacts in connectors is well known. U.S. Pat. Nos. 3,521,222; 3,678,445; 3,897,125; 4,106,839 and 4,239,318 disclose annular shields formed of sheet metal with resilient fingers which electrically engage the outer surface of the plug barrel and the inner surface of the receptacle shell of the electrical connector.

U.S. Pat. No. 3,835,443 discloses an electrical connector shield comprising a helically coiled conductive spring which is interposed between facing annular surfaces on the mating halves of an electrical connector. The spring is coiled in such a manner that the convolutions thereof are slanted at an oblique angle to the center axis of the connector members. When the connector members are mated, the spring is axially flattened to minimize the gap between the convolutions thereof and to provide a wiping electrical engagement with the annular surfaces on the mating halves of the connector.

U.S. Pat. No. 4,033,654 discloses another form of slant coil spring shield for an electrical connector in which the spring is mounted in an internal groove formed in the receptacle shell. The convolutions of the spring are arranged in such a fashion that they will collapse radially when the plug barrel is inserted into the receptacle shell.

Each of the foregoing shielding devices has the disadvantage that slots or gaps exist in the device which allow some EMI/RFI leakage into the connector. Also, the devices are costly and damage sensitive.

U.S. Pat. No. 3,336,566 discloses a coaxial connector embodying a two layer contact member for preventing signal leakage from the interior of the connector. The two layers embody reversely bent, overlapping spring fingers. The fingers of one layer are offset from the fingers of the other layer so that the fingers of each layer overly the boundaries formed between the fingers of the other layer to provide a generally continous contact member. The resilient fingers expand radially outwardly when a tubular conductive member on a coaxial cable is pushed into the interior of the contact member. While this double layer arrangement provides a peripherally continuous shield, it is expensive to manufacture and the slits in the two layers of the contact member which form the resilient fingers provide sharp edges which is undesirable.

It is the object of the present invention to provide a simple, inexpensive and effective grounding ring for an electrical connector which provides a windowless EMI/RFI shield between the mating halves of the electrical connector at their interface.

SUMMARY OF THE INVENTION

According to a principal aspect of the present invention, there is provided an electrical connector comprising first and second mating connector members each including a conductive shell. A ring is mounted on one of the shells. The ring has a wall of "C"-shaped configuration in longitudinal section. When the connector members are mated the other shell telescopically engages with a peripheral wall of the ring causing such wall to resiliently deflect radially to provide a firm connection between the two shells. The spring resistance that is built up in the ring during its deflection insures that intimate contact is provided between the connector members of the assembly. The ring has a continuous wall thereby providing a windowless EMI/RFI shield at the interface of the connector members if the ring is formed of a conductive material. Further, the ring has a smooth surface and, therefore, is difficult to snag and damage as are the prior art shields.

DESCRIPTION OF THE PREFERRED EMBODIMENT

Figure 1:
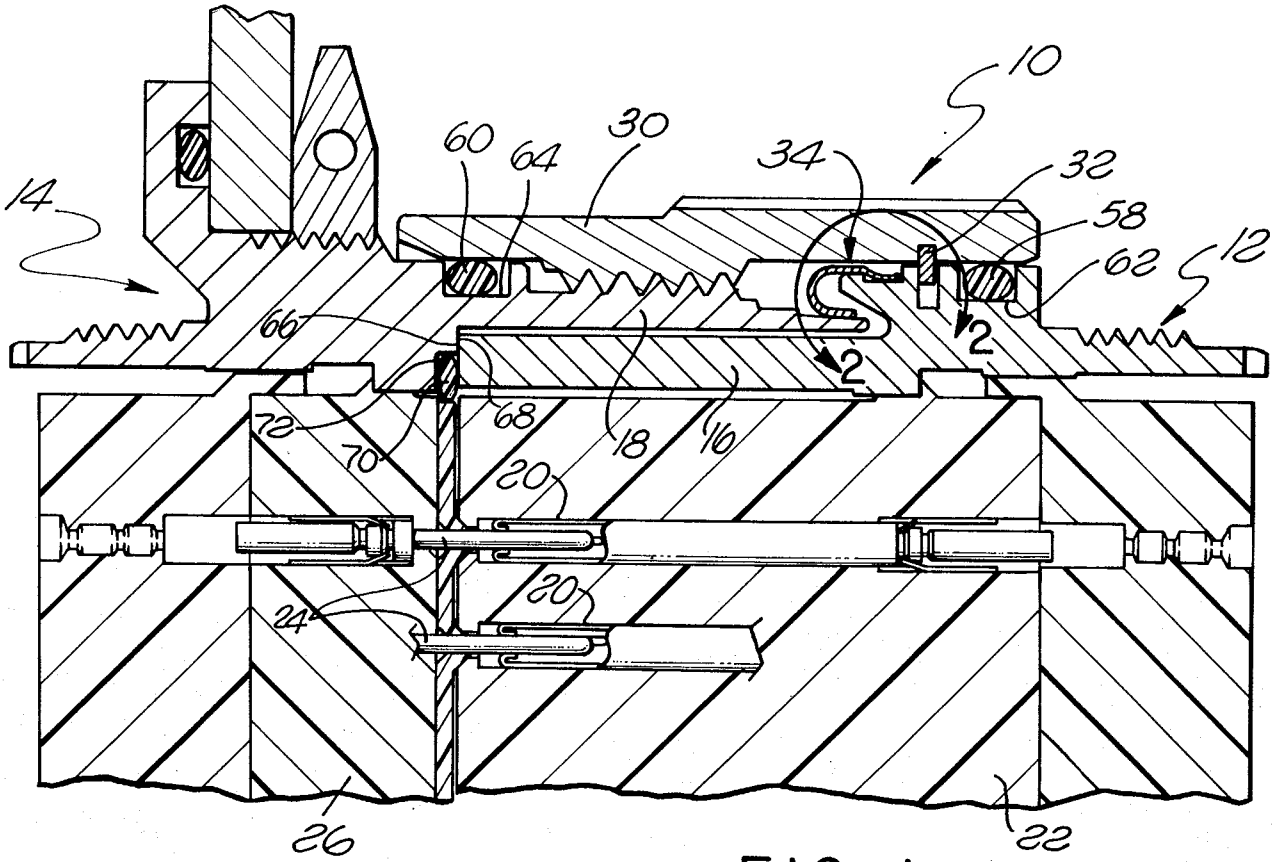
FIG. 1 is a partial, longitudinal sectional view through an electrical connector, shown in its fully mated condition, embodying the grounding ring of the present invention.

Referring now to the drawings in detail, there is shown in FIG. 1 an electrical connector, generally designated 10, comprising a plug connector member 12 and a receptacle connector member 14. The plug connector member comprises a cylindrical barrel 16 which is telescopically mounted in the front end of the cylindrical shell 18 of the receptacle connector member. A plurality of socket contacts 20 are axially positioned in an insulator 22 in the barrel 16. Each such contact 20 receives a pin contact 24 mounted in an insulator 26 in the receptacle connector member 14. A coupling nut 30 is retained on the barrel 16 of the plug connector member by a retaining ring 32. The forward end of the coupling nut is threadedly engaged with the shell 18 of the receptacle connector member 14. A bayonet coupling could be used instead, if desired.

In accordance with the invention, a resilient, single layer sheet metal grounding ring 34 is mounted in the plug connector member 12. As seen in the drawings, the grounding ring is somewhat in the form of a section of a hollow toroid having a wall in longitudinal section of generally "C"-shaped configuration. The convex outer surface 36 of the ring faces forwardly toward the receptacle connector member 14. The wall of the ring is continuous. That is the wall contains no slots or slits. The outer portion 38 of the ring embodies a rearwardly extending mounting flange 40 which is tightly fit within an angular groove 42 formed in an enlarged section 44 of the plug barrel 16. The flange may be dimensioned to have a snap-fit in the groove 42 when the ring is pushed onto the enlarged section of the plug barrel. Alternatively, the flange may be rolled into the groove after installing the ring over the enlarged section of the barrel, or the ring might be welded to the outer cylindrical surface of the enlarged section. A push-on snap-fit mounting of the flange 40 in the groove 42 has the advantage that it avoids the need for secondary assembly operations to secure the ring onto the barrel 16, and allows ready replacement of the ring in the event that it is damaged during use of the connector. Preferably the forward edge of the enlarged section 44 is rounded as indicated at 45 and the rear 46 of the ring flange 40 flares outwardly to facilitate the pushing of the ring over the forward part of the enlarged section in front of the groove 42. Of course, the interference of the flange 40 with the forward portion of the shell that lies forward of the groove 42, is small enough that the flange can be forced past the forward shell portion without destroying either one.

Figure 3:
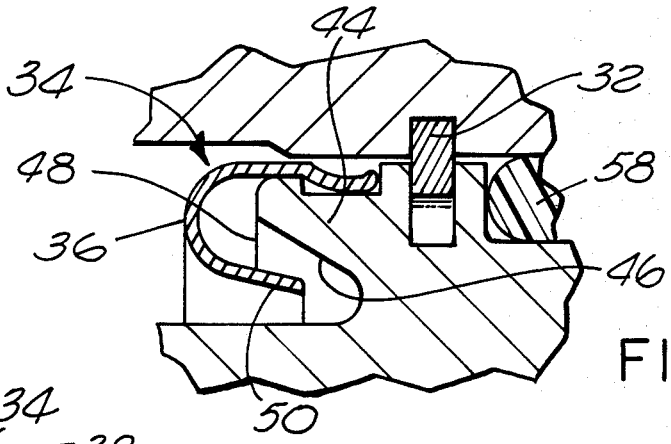
FIG. 3 is an enlarged sectional view similar to FIG. 2, but showing the grounding ring in its unstressed condition when the two halves of the connector are disengaged.
Figure 4:
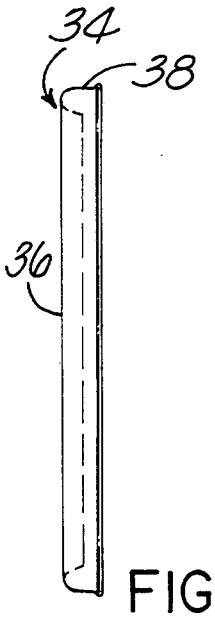
FIG. 4 is a side view of the grounding ring of the invention.
Figure 5:
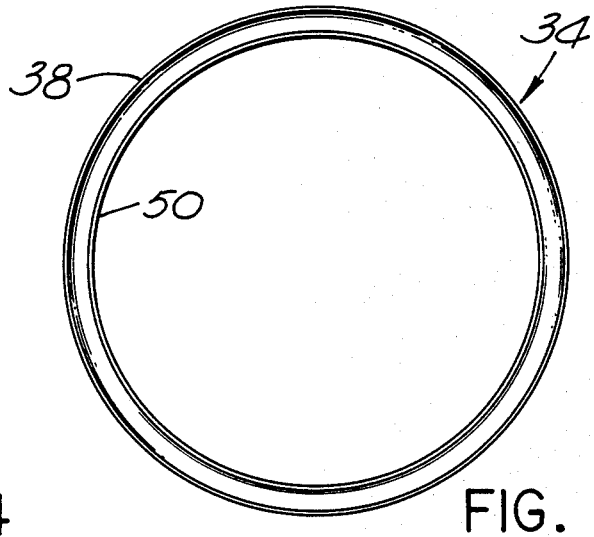
FIG. 5 is a rear elevational view of the grounding ring.

A generally V-shaped undercut 47 is formed in the forwardly facing wall 48 of the enlarged section 44 of the barrel. The inner peripheral wall 50 of the "C" section ring provides a free end contacting portion which extends into the undercut 47. Preferably the contacting portion 50 tapers rearwardly and inwardly when unstressed, as illustrated in FIG. 3. It can be seen in FIG. 3 that the tip of the inner peripheral wall 50, lies radially inward of all other portions of the ring.

Figure 2:
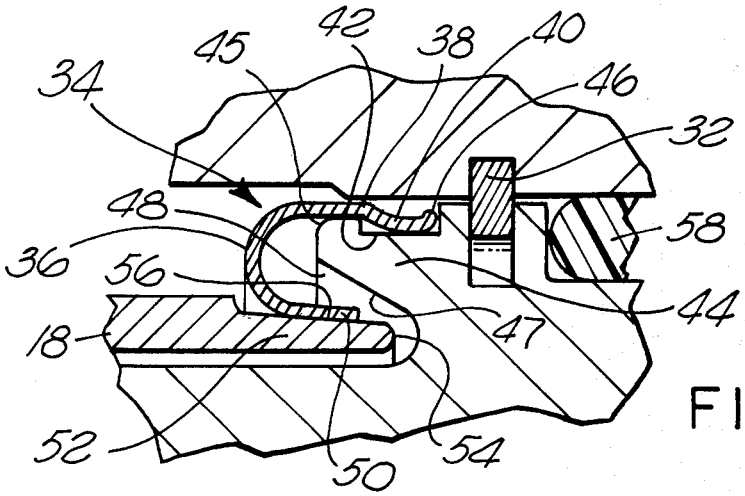
FIG. 2 is an enlarged sectional view of the area delineated by the arrow 2—2 of FIG. 1, showing the ring in a deflected condition when the two halves of the connector are fully mated.

The receptacle shell 18 embodies a forward, relatively narrow generally cylindrical shaped nose 52 which is dimensioned to have a sliding interference fit within the interior of the grounding ring 34 when the plug and the receptacle connector members are mated. Thus, when the connector members are mated, the nose 52 on the receptacle shell will cause the free end contacting portion 50 of the grounding ring to expand radially outwardly as best seen in FIG. 2. Preferably the end 54 of the nose 52 is rounded to facilitate insertion of the nose into the interior of the grounding ring. Also, preferably the outer surface 56 of the nose slightly tapers forwardly and inwardly. The rearwardly and inwardly tapered contacting portion 50 of the ring and the tapered outer surface 56 of the nose 52 on the receptacle shell permit the nose to be inserted into the interior of the ring with relatively low force and avoids the necessity of high manufacturing tolerances to be maintained in order to provide good electrical contact between the nose and the ring. Furthermore, the cooperating tapered surfaces on the nose and the ring allow a gradual deflection of the contacting portion 50 of the ring, thereby minimizing high local forces which could cause permanent deformation of the ring.

The spring resistance that builds up upon radial deflection of the contacting portion 50 of the grounding ring by the nose 52 on the receptacle shell assures that intimate electrical contact is provided between the plug barrel and receptacle shell. Such electrical contact is maintained between the mated halves of the connector even though the connector may be subjected to high vibration or numerous matings and unmatings of the connector halves.

The grounding ring may be formed of any suitable resilient conductive material, such as beryllium copper, aluminum and stainless steel. The ring has the significant advantage that it is very simple in construction, inexpensive to produce and install in the connector, and provides a windowless EMI/RFI grounding shield for the connector. Furthermore, the radially deflected ring which tightly engages the nose 52 on the end of the shell 18 may provide an effective environmental seal between the mating halves of the connector, which will prevent intrusion into the interior of the connector of moisture, dust, etc.

While the grounding ring which has been illustrated in the drawings and described so far has its contacting portion 50 on the interior of the ring, so that it will be engaged by a nose on the receptacle shell inserted into the interior of the ring, it will be appreciated that contacting portion of the ring could be provided by the outer peripheral wall of the ring, with the inner periphery of the ring being fixed to the plug barrel. In this case the cylindrical nose on the forward end of the receptacle shell would be dimensioned to slide over the outside of the ring in order to provide the grounding connection and EMI/RFI grounding shield at the interface of the mating halves of the connector. However, with such arrangement the contacting portion of the ring 50 being on the outside would be more exposed, and thus more likely to be damaged during use of the connector. Accordingly, the arrangement illustrated in drawings wherein the contacting portion of the grounding ring is provided by the inner peripheral wall of the ring, with such portion extending into the undercut 46, is the preferred arrangement.

If desired, sealing rings 58 and 60, such as elastomeric O-rings, may be mounted in annular grooves 62 and 64, respectively, in the plug barrel and receptacle shell to provide an environmental seal between those parts and the coupling nut 30. Also, the forward end 66 of the barrel 16 may be dimensioned to have a butt engagement with a forwardly facing annular shoulder 68 on the interior of the receptacle shell to provide a secondary ground connection between the barrel and shell. Also, an elastomeric sealing ring 70 may be interposed between the forward end 66 of the barrel 16 and the bottom of a groove 72 interior of the surface 68 on the receptacle shell to provide additional environmental sealing between the mating halves of the connector.

It will be appreciated from the foregoing that the connector of the present invention is capable of withstanding severe environmental conditions, and the peripherally continuous grounding ring between the mating halves of the connector will provide reliable, long term protection against unwanted external EMI/RFI signals.

If grounding or shielding is not required, the ring 34 could be formed of a suitable resilient material, such as an elastomer, to function simply as an environmental seal.

What is claimed is:

1. An electrical connector member comprising:

a first shell surrounding an insulator adapted to contain electrical contacts, said shell having a forward end;

a peripherally continuous, single-layer annular ring mounted on said shell;

the wall of said ring, in longitudinal section, having a generally C-shaped configuration with opposite ends and a middle, and with the convex surface thereof facing forwardly of said shell;

said ring embodying a radially resilient free-end contacting portion;

said contacting portion of said ring resiliently deflecting radially when the connector member is mated with a second connector member having a second shell which telescopically engages with said contacting portion;

said C-shaped ring surrounding said forward end of said first shell so one end of said C-shaped configuration lies on the radially outer side of said shell and the other end of said C-shaped configuration lies on the radially inner side of said shell.

2. An electrical connector comprising:

first and second mating connector members each including a shell with a forward end that can telescope into the forward end of the other, said first shell having a larger forward end than said second shell;

a peripherally continuous, single-layer annular ring mounted on said first shell;

the wall of said ring, in longitudinal section, having a generally C-shaped configuration with the convex surface thereof facing forwardly toward the other of said shells, said C-shaped configuration forming a radially outer portion mounted on said first shell member;

said ring embodying a radially free inner contacting portion extending inwardly of said first shell forward end, said contacting portion having a tip which lies radially inwardly of all other portions of the ring;

said second shell telescopically engaging with said contacting portion of said ring when said connector members are mated causing said contacting portion to resiliently deflect radially to thereby provide a firm connection between said shells.

3. An electrical connector as set forth in claim 2 wherein:

the outer surface of said second shell which engages said tip of said ring is tapered forwardly and inwardly.

4. An electrical connector member comprising:

a first shell surrounding an insulator adapted to contain electrical contacts;

a peripherally continuous, single-layer annular ring mounted on said shell;

the wall of said ring, in longitudinal section, having a generally C-shaped configuration with the convex surface thereof facing forwardly of said shell;

said ring embodying a radially resilient free-end contacting portion;

said contacting portion of said ring resiliently deflecting radially when the connector member is mated with a second connector member having a shell which telescopically engages with said contacting portion;

said first shell having a shallow groove rearward of a forward shell portion and said ring having a mounting ring flange opposite said contacting portion, that has an interference fit with said forward portion of the shell that lies forward of said groove, said interference fit being small enough that the mounting ring flange can be forced past the forward shell portion into the groove without destroying either the flange or the shell.

* * * * *